US006851431B2

(12) United States Patent
Mayeri

(10) Patent No.: US 6,851,431 B2
(45) Date of Patent: Feb. 8, 2005

(54) COLLAPSIBLE HAIR BRUSH

(76) Inventor: Joseph Mayeri, 2501 30th Ave., San Francisco, CA (US) 94118

( * ) Notice: Subject to any disclaimer, the term of this patent is extended or adjusted under 35 U.S.C. 154(b) by 296 days.

(21) Appl. No.: 10/259,984

(22) Filed: Sep. 30, 2002

(65) Prior Publication Data

US 2004/0060571 A1 Apr. 1, 2004

(51) Int. Cl.[7] ..... A45D 24/16
(52) U.S. Cl. ..... 132/121; 15/184
(58) Field of Search ..... 132/121, 123, 132/151; 15/184, 185, 191.1, 201, 203

(56) References Cited

U.S. PATENT DOCUMENTS 450,042 A * 4/1891 Schultz ..... 15/203
818,696 A * 4/1906 Kulenkampff ..... 15/203
1,889,182 A * 11/1932 Rosenberg ..... 15/203
2,774,096 A * 12/1956 Everard ..... 15/203
2,814,819 A * 12/1957 De Ayerbe ..... 15/203
2,844,836 A * 7/1958 Irving ..... 15/203
3,048,866 A * 8/1962 Thompson ..... 15/53.4
4,987,633 A * 1/1991 Heneveld ..... 15/185
5,815,877 A * 10/1998 Heneveld ..... 15/203

* cited by examiner

*Primary Examiner*—Kevin Shaver
*Assistant Examiner*—Stephanie L. Willatt

(57) ABSTRACT

Collapsible hair brush with a brush retaining housing. The housing is open on one end. A bristle holding plate and attached bristles are capable of sliding into the housing and out to the the open end of the housing. A bristle plate end block has an outwardly protruding stop pin that interacts with a longitudinally disposed slot in one side of the inner brush retaining housing. The bristles are each comprised of a shaft member whose bottom portion terminates in a spring retaining shoulder and integral downwardly disposed flexible shaft member. An extension spring surrounds each the downward shaft and penetrates and is retained by the bristle holding plate. This configuration allows the bristles to bend when they slide into the housing forming a compact unit that can be carried in a pocket or purse and to then pop up when slid out from the housing.

3 Claims, 9 Drawing Sheets

COLLAPSIBLE HAIR BRUSH

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of hair brushes and more specifically to a collapsible hair brush.

Hair brushes of various types for the purpose of creating a neat appearance of a person's hair have been in existence for hundreds of years.

Hair brushes have been constructed of a variety of materials but are generally comprised of a handle portion, a brush head and a plurality of bristles protruding out from the brush head. Brush handles and heads have been constructed of wood, metal and plastic. Bristles have been made of wood, plastic rubber and other resilient and non resilient materials. The bristles are usually attached to the head by insertion into a plurality of apertures in the head. Some recent forms of brushes include means to make them more compact during storage. These include folding handles and even bristles that fold or bend to lie in a flatter position.

There is a deficiency in prior technology regarding brushes with folding bristles in that exiting brushes usually compromise on the quality of the bristles in that they are usually stiff and have a mechanical hinge that causes them to be somewhat loose in the use position. The resilient quality of bristles that is usually found in superior brushes is lacking.

BRIEF SUMMARY OF THE INVENTION

The primary object of the invention is to provide a hair brush that is compact and can be easily carried in a pocket or purse.

Another object of the invention is to provide a hair brush that has foldable bristles and retractable bristle head that are protected by a protective housing.

Another object of the invention is to provide a hair brush that has improved resilient bristles for an improved hair brushing experience.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Collapsible hair brush comprising: a brush retaining housing, said housing being open on one end a bristle holding plate and attached bristles, said bristle holding plate capable of sliding into said housing and out to the said open end of said housing, a bristle plate end block having an outwardly protruding stop pin that interacts with a longitudinally disposed slot in one side of said inner brush retaining housing, said bristles each being comprised of a shaft member whose bottom portion terminates in a spring retaining shoulder and integral downwardly disposed flexible shaft member, an extension spring surrounding each said downward shaft, and said downward shaft penetrating said bristle holding plate and being retained by said bristle holding plate by passing said downward shaft through an aperture in said bristle holding plate and deforming said downward post tip into a head that is larger than the aperture in said bristle holding plate.

BRIEF DESCRIPTION OF THE DRAWINGS

The drawings constitute a part of this specification and include exemplary embodiments to the invention which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
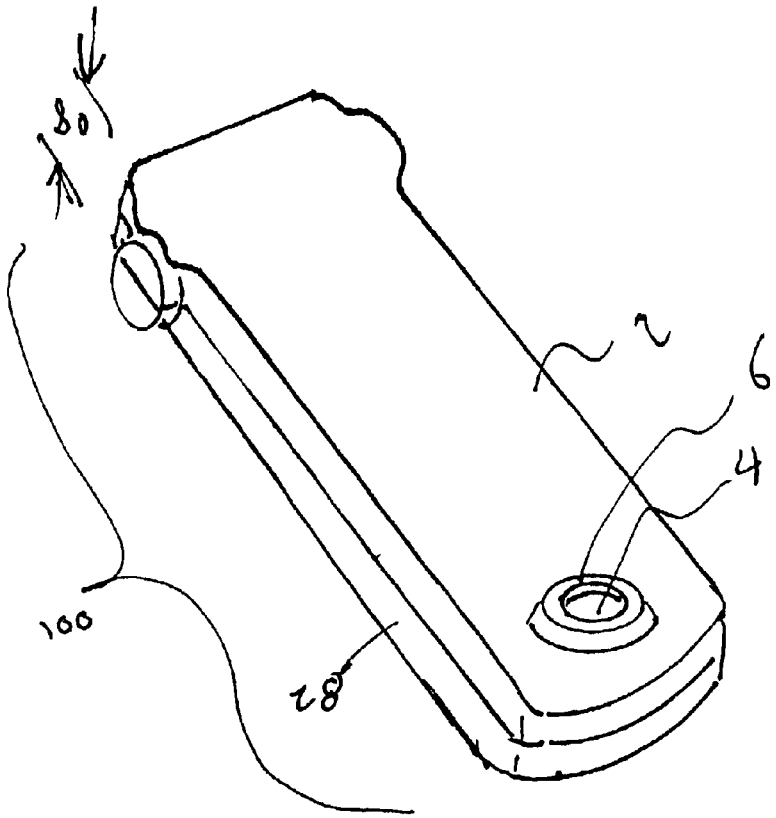
FIG. 1 is a perspective view of the invention in the closed position.
Figure 2:
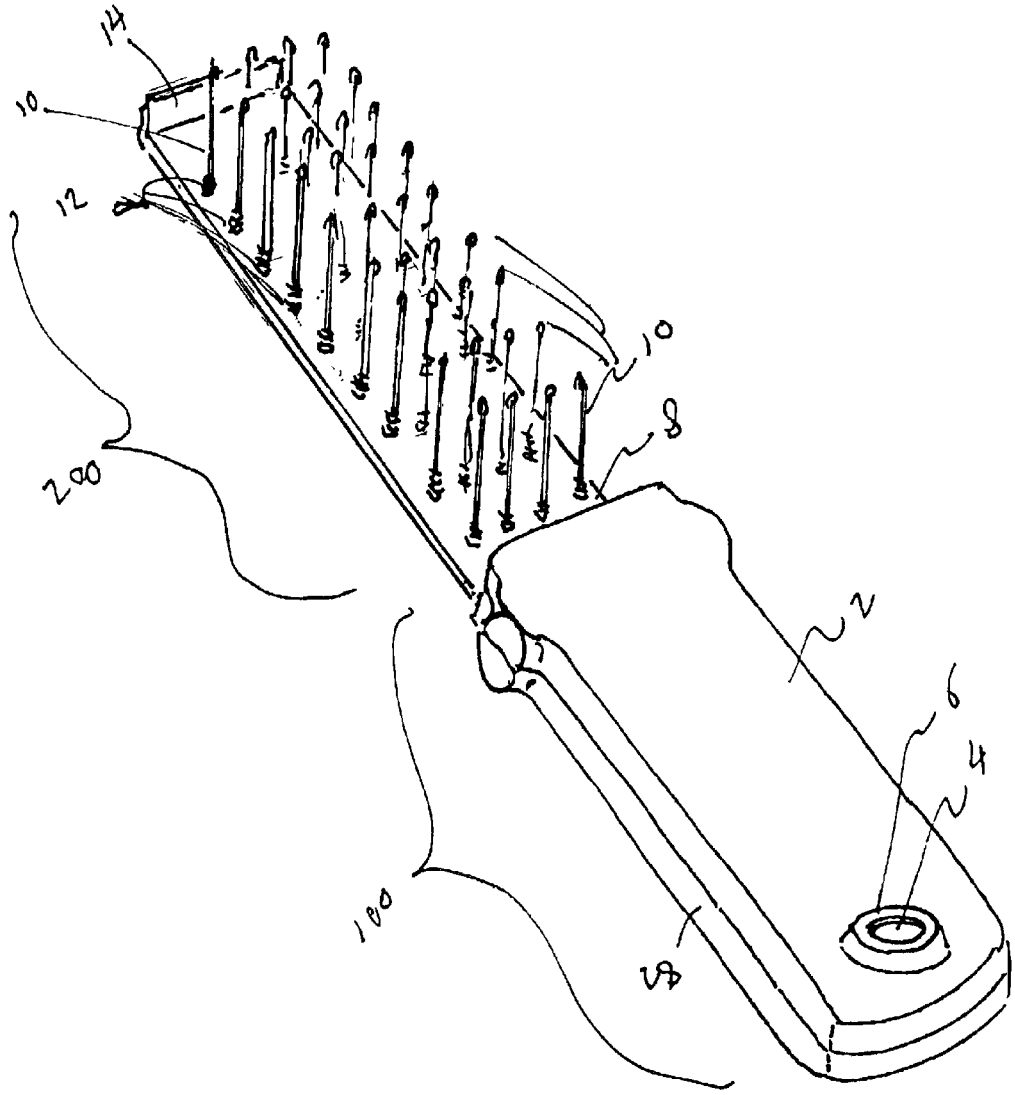
FIG. 2 is a perspective view of the invention in the open position.
Figure 3:
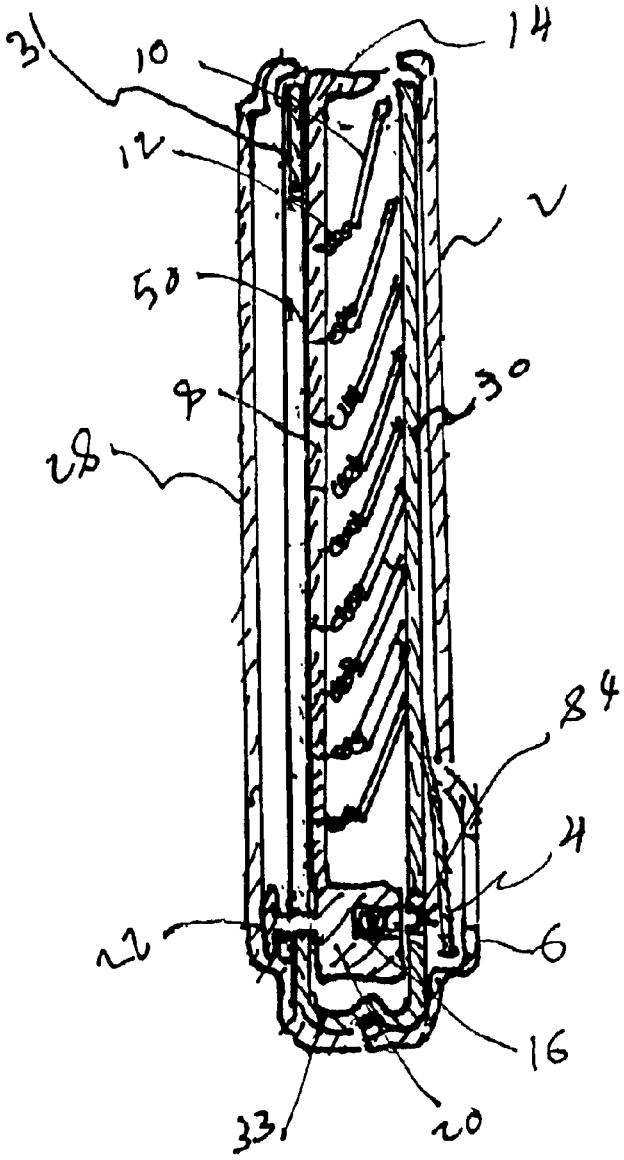
FIG. 3 is a side section view of the present invention.
Figure 4:
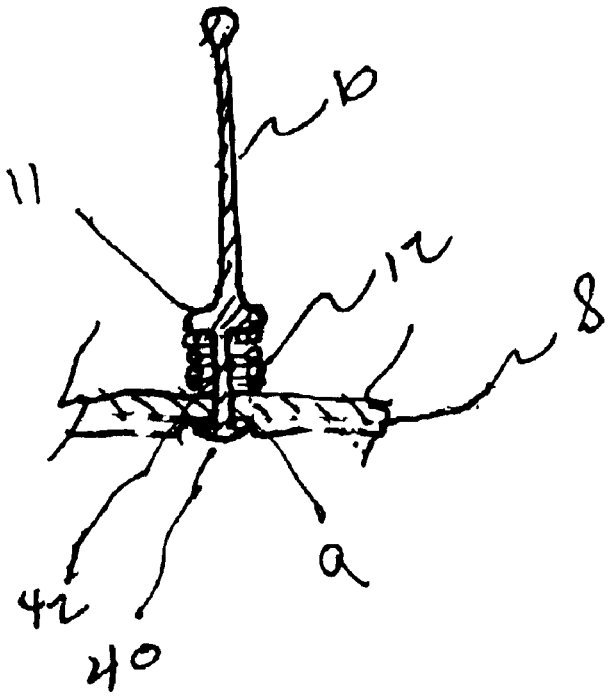
FIG. 4 is a side section view of a bristle in the up position.
Figure 5:
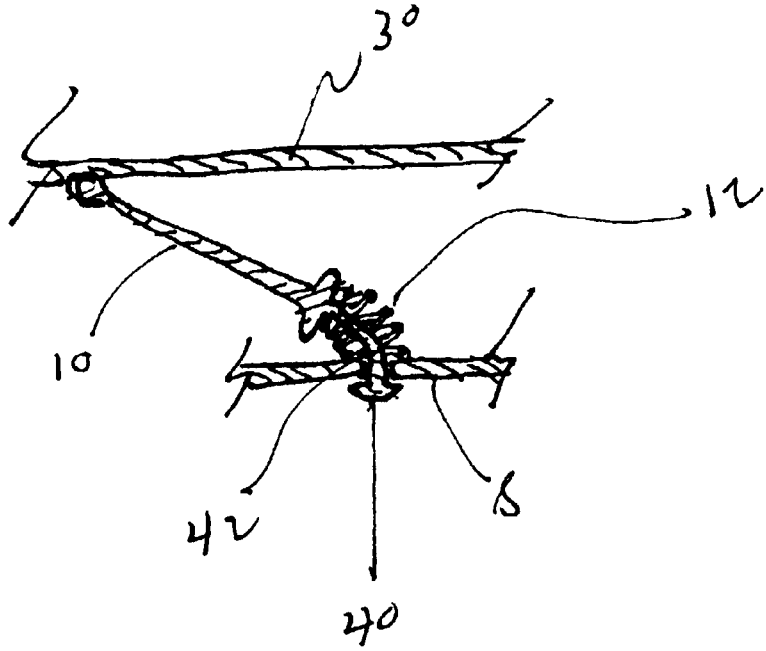
FIG. 5 is a side section view of a bristle in the folded position.
Figure 6:
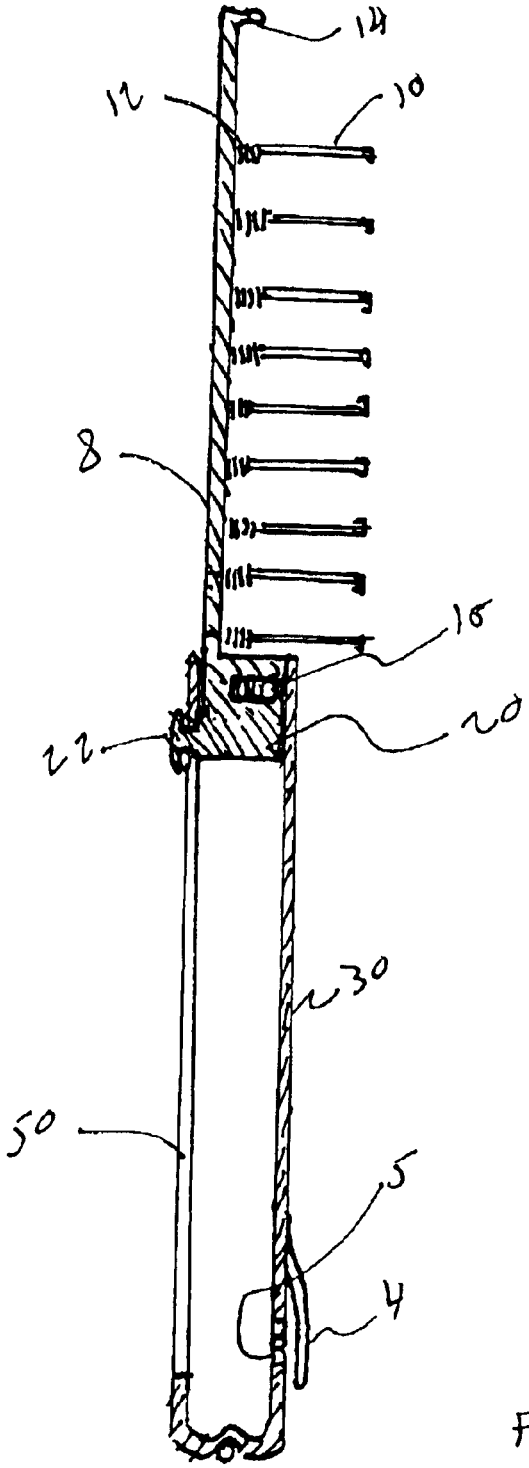
FIG. 6 is a side section view of the invention in the open position.
Figure 7:
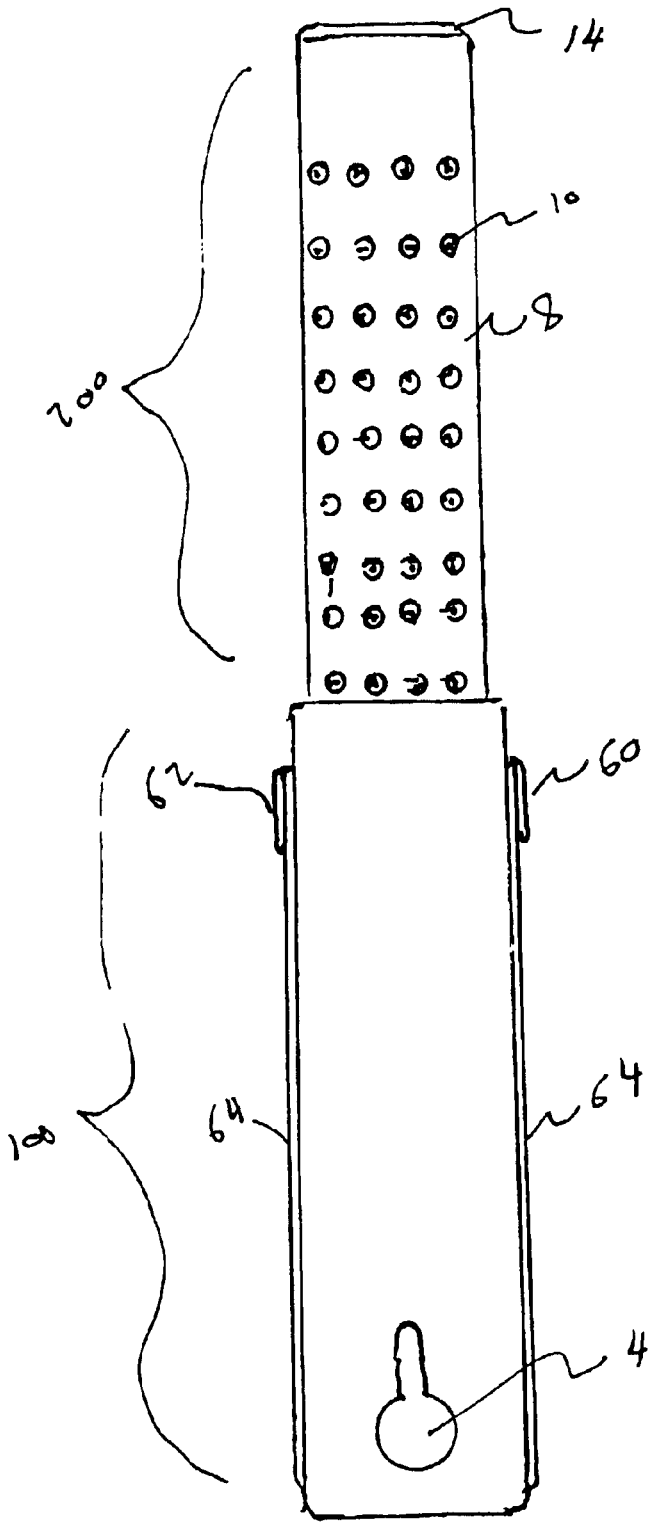
FIG. 7 is a plan view of the invention in the open position.
Figure 8:
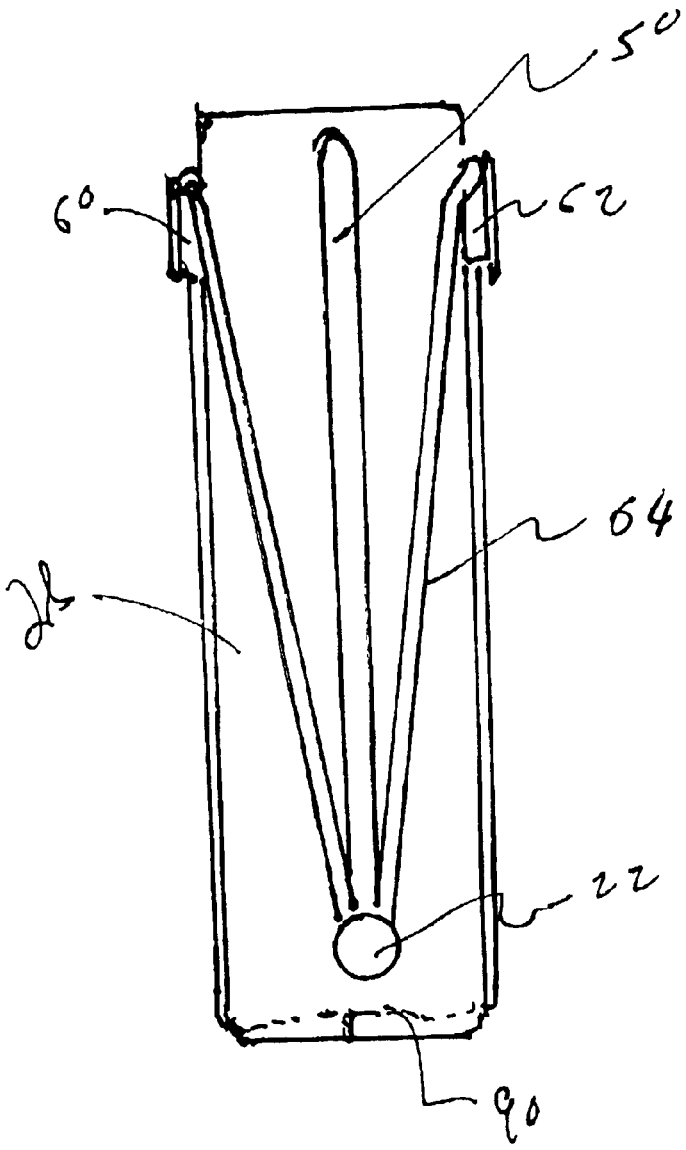
FIG. 8 is a plan view of the invention showing the spring member.
Figure 9:
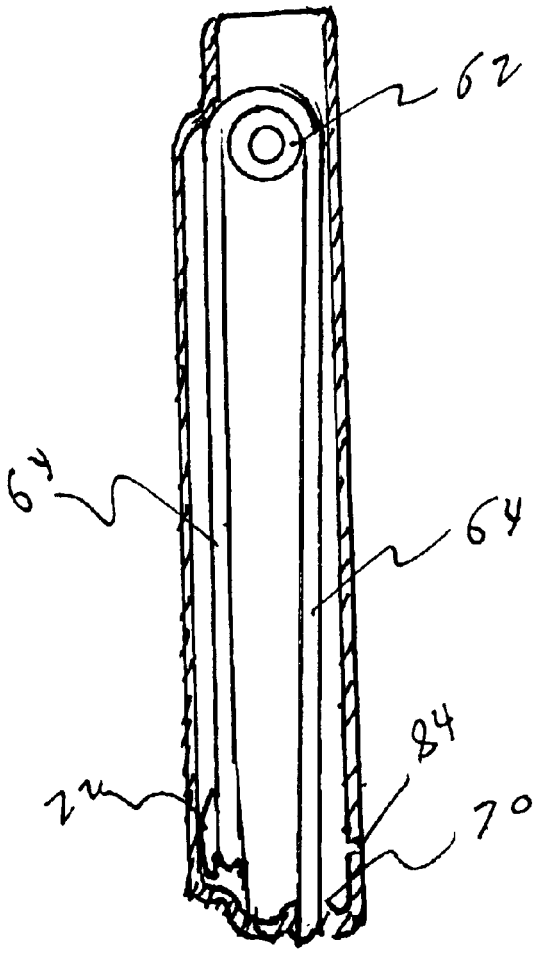
FIG. 9 is a side view of the present invention showing the spring member.

Referring now to FIG. 1 we see a perspective view of the present invention in the closed position. An outer housing is comprised of a top half 2 and a bottom half 28. A push button 4 is recessed into button retaining portion 6 so that it can not be accidentally pushed while stored in a pocket or purse. The overall side profile of the housing 100 is relatively thin, approximately three quarters on an inch 80 and approximately one and one half inch wide. FIG. 2 shows the present invention with brush head assembly 200 popped out of housing assembly 100. Bristles 10 mounted to bristle plate 8 and are in the deployed position. Each spring 12 is located at the bottom of each bristle to allow them to fold while in the housing 100 and return to a straight position in the use position shown. L shaped end plate 14 helps the user push the brush head 200 back into housing 100. FIG. 3 is a side section view of the present invention. Bristles 10 are shown in their folded potion when pushed into an inner housing defined by side plates 30, 31 and end plate 33. The other end of the inner and outer housing are open to allow brush assembly 200 to slide out. A slot in plate 31 allows a post 22 to protrude out of plate 31 and to slide from its shown position to a deployed position as shown in FIG. 6. Referring back to FIG. 3, bristle holding plate 8 terminates at one end in a block 20 and at the other end in push plate 14. Block 20 includes within it a spring plunger ball assembly. The ball can protrude up into aperture 84. When the user presses on button plate 4, it causes ball assembly 16 to depress thereby allowing the brush assembly to slide out. When post 22 hits the end of slot 50, the brush head is prevented from traveling further. FIG. 4 shows an enlarged view of a bristle 10 having a spring retaining shoulder 11 and a downwardly disposed shaft 40 that is thin and retains spring 12 and penetrates aperture 9 in brush plate 8. The downward shaft 40 is then deformed into a head 40 by means of ultrasonic welding. The bristles are can be made of molded plastic such as nylon, or can be made of other standard bristle materials and the retaining head 40 can be a separate item such as a standard metal fastener of the like. The retaining heads are recessed into the bottom of plate 8 so that their tops are flush with the lower surface of plate 8 thereby allowing unimpeded travel of plate 8 within the brush housing. FIG. 5 shows the bristle 10 in the folded position held down by housing plate 30. Spring 12 is made of stainless steel or the like and can be left in the deformed position as shown for an indefinite period of time. If the bristle 10 were to rely on the spring properties of a plastic such a nylon or the like and remain in the folded position for an extended period of time, the bristle would eventually take a cold set and not return to its full upright position. Additionally, the bristle would be inferior for brushing hair in that if it had a thin enough lower diameter to allow for effective bending, it would be too bendable to withstand the action and resistance of hair brushing. FIG. 6 shows the brush in the out position. The invention may be used as described by the user sliding post 22 forward as shown or backward as shown in FIG. 3. However, the preferred embodiment includes a spring assembly that causes the brush to automatically deploy when button 4 is pushed. FIG. 7 shows a plan view of the invention where bearings 60 and 62 are shown as well as latex spring member 64. FIG. 8 shows Spring member 64 in the stretched position and is held from springing forward by post 22. Post 22 is restrained from motion by spring ball plunger 16 already described. Latex spring 64 wraps around bearings 60, 62 and is retained at the back of the housing as shown by dotted line 90. When the user presses button 4 as shown in FIG. 3, post 22 is automatically drawn to the opposite end of slot 50 causing the brush head to pop out. FIG. 9 shows a side view indicating how spring 64 wraps around bearing 62 and terminates in recess 70 at one end and wraps around post 22 at a central point. The brush of the present invention therefore can be produced in a manual version where the user physically pushes the brush head out, our an automatic version where a latex or other standard spring forces the brush head out.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Collapsible hair brush comprising:

a brush retaining housing;

said housing being open on one end a bristle holding plate and attached bristles;

said bristle holding plate capable of sliding into said housing and out to the said open end of said housing;

a bristle plate end block having an outwardly protruding stop pin that interacts with a longitudinally disposed slot in one side of said inner brush retaining housing;

said bristles each being comprised of a shaft member whose bottom portion terminates in a spring retaining shoulder and integral downwardly disposed flexible shaft member;

an extension spring surrounding each said downward shaft; and said downward shaft penetrating said bristle holding plate and being retained by said bristle holding plate by passing said downward shaft through an aperture in said bristle holding plate and deforming said downward post tip into a head that is larger than the aperture in said bristle holding plate.

2. Collapsible hair brush as claimed in claim 1 further comprising a spring member such as latex tubing or the like that is stretched on the outside of said brush retaining housing and attached at both ends to said housing and engaged with said outwardly protruding stop pin so that said spring causes said bristle holding plate and attached bristles to pop out of the end of said brush retaining housing;

said end block having a spring plunger ball that can interact with an aperture in said housing to releasably retain said bristle plate within said housing until the user presses on said ball to release it from said aperture causing said bristle plate to pop out of said housing.

3. Collapsible hair brush as claimed in claim 1 further comprising an outer housing that encloses said brush holding housing that also covers said spring member.

* * * * *